US007097807B1

(12) United States Patent
Meeks, III et al.

(10) Patent No.: US 7,097,807 B1
(45) **Date of Patent: *Aug. 29, 2006**

(54) NANOCRYSTALLINE ALUMINUM ALLOY METAL MATRIX COMPOSITES, AND PRODUCTION METHODS

(75) Inventors: Henry S. Meeks, III, Roseville, CA (US); Marc S. Fleming, Rancho Cordova, CA (US)

(73) Assignee: Ceracon, Inc., Carmichael, CA (US)

( * ) Notice: Subject to any disclaimer, the term of this patent is extended or adjusted under 35 U.S.C. 154(b) by 471 days.

This patent is subject to a terminal disclaimer.

(21) Appl. No.: 10/405,752

(22) Filed: Apr. 3, 2003

Related U.S. Application Data

(63) Continuation-in-part of application No. 09/663,621, filed on Sep. 18, 2000, now Pat. No. 6,630,008.

(51) Int. Cl.
*B22F 3/14* (2006.01)
*B22F 3/02* (2006.01)

(52) U.S. Cl. ..... 419/48; 419/66

(58) Field of Classification Search ..... 419/58, 419/51, 48, 66

See application file for complete search history.

(56) References Cited

U.S. PATENT DOCUMENTS

| | | | | |
|---|---|---|---|---|
| 4,134,759 | A | 1/1979 | Yajima et al. | |
| 4,499,048 | A | 2/1985 | Hanejko | |
| 4,499,049 | A | 2/1985 | Hanejko | |
| 4,501,718 | A | 2/1985 | Bradt | |
| 4,539,175 | A | 9/1985 | Lichti et al. | |
| 4,640,711 | A | 2/1987 | Lichti et al. | |
| 4,667,497 | A | 5/1987 | Oslin et al. | |
| 4,915,605 | A | 4/1990 | Chan et al. | |
| 4,933,140 | A | 6/1990 | Oslin | |
| 4,961,778 | A | 10/1990 | Pyzik et al. | |
| 5,032,352 | A | 7/1991 | Meeks et al. | |
| 6,123,896 | A | 9/2000 | Meeks, III et al. | |
| 6,309,594 | B1 | 10/2001 | Meeks, III et al. | |
| 6,355,209 | B1 | 3/2002 | Dilmore et al. | |
| 6,630,008 | B1 * | 10/2003 | Meeks et al. | 75/236 |

* cited by examiner

*Primary Examiner*—Daniel Jenkins

(57) ABSTRACT

Objects comprising Al-7.5 Mg particulate having pressure consolidated nanocrystalline coating material are formed. Oxides of the coating material, in particulate form, may become dispersed in the pressure consolidated, thereby increasing its strength.

23 Claims, 13 Drawing Sheets

500 X UN-COATED ESK
SiC POWDER

380 X 55 w/o Al COATED
ESK SiC

1700 X 35 w/o Al COATED
ESK SiC

400 X 35 w/o Al COATED
ESK SiC

NODULAR AND "FEATHERY"
ALUMINUM COATING ON SiC POWDER SURFACE

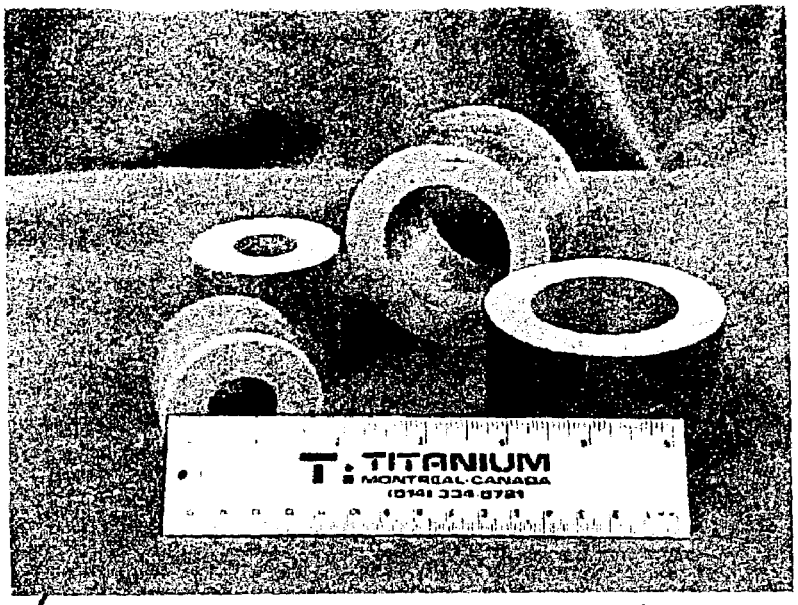
FIG. 5. 80% DENSE, 25 v/o SiC FORGING PREFORMS
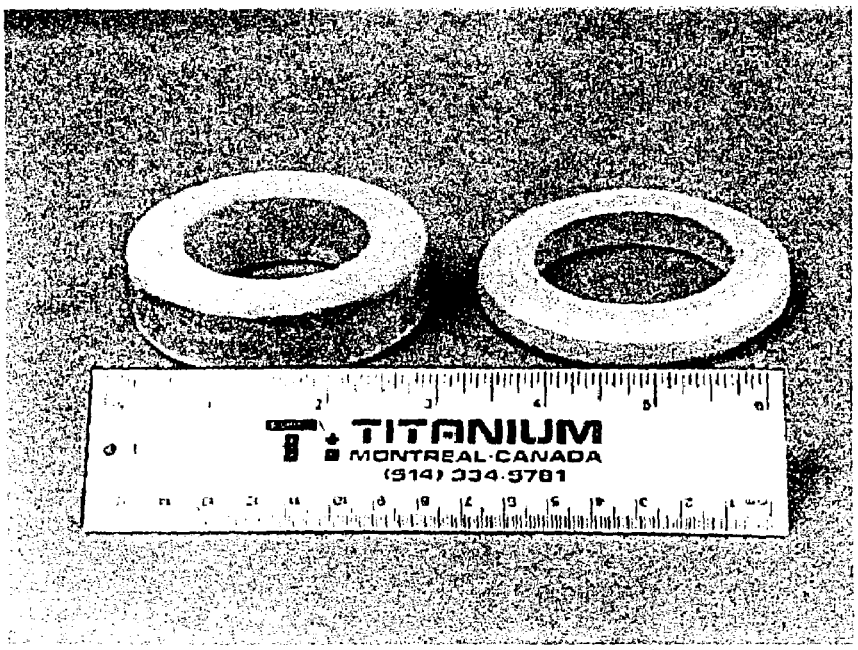
(a) 80% DENSE PREFORM (b) 100% DENSE FORGED FLANGE
FIG. 6.

200X SEM IMAGE OF
25 v/o SiC COMPOSITE

FLEXURE STRENGTH VS. ALUMINUM CONTENT

FLEXURE MODULUS VS. ALUMINUM CONTENT
LOT 1
LOT 2
LOT 3
TOTAL DEVIATION
REFERENCE Be
REF. LINE FOR PURE BERYLLIUM
35% SiC
25% SiC
REF. LINE FOR CURRENT "STATE OF ART" ALUMINUM MMC
CURRENT PM Al/SiC 50A
60% SiC
FLEXURE MODULUS (MSI)
50
40
30
20
10
0
20
40
60
80
ALUMINUM CONTENT (Wt %)
SPECIMEN:
.06" X .08" X 1.0"
.75" - .83"

Al/SiC COMPOSITE DENSITY VS. THEORETICAL

NANOCRYSTALLINE ALUMINUM ALLOY METAL MATRIX COMPOSITES, AND PRODUCTION METHODS

BACKGROUND OF THE INVENTION

This application is a continuation-in-part of prior U.S. application Ser. No. 09,663,621, filed Sep. 18, 2000, now U.S. Pat. No. 6,630,008.

This invention relates generally to powder preform consolidation processes, and more particularly to such processes wherein substantially texture free nanocrystalline aluminum alloy metal matrix composites are produced or formed.

One of the most promising methods to improve the mechanical and physical properties of aluminum, as well as many other materials, is that of nanocrystalline engineering. Significant interest has been generated in the field of nanostructured materials in which the grain size is usually in the range of 1–100 nm. More than 50 volume percent of the atoms in nanocrystalline materials could be associated with the grain boundaries or interfacial boundaries of nanocrystalline materials when the grain size is small enough. A significant amount of interfacial component between neighboring atoms associated with grain boundaries contributes to the physical properties.

Designers of modern commercial and military aerospace vehicles and space launch systems are constantly in search of new materials with lower density, greater strength, and higher stiffness. New technical challenges, such as those presented by the Integrated High Performance Rocket Propulsion Technology (IHPRPT) program, are ideal proving grounds for advanced materials. To meet these challenges much effort has been directed toward developing intermetallics, ceramics and composites as structural and engine materials for future applications. For structural airframes aluminum alloys have long been preferred for civil and military aircraft by virtue of their high strength-to-weight ratio, though the use of composite materials, particularly for secondary structures, is rapidly increasing. Nearly 75% of the structure weight of the Boeing 757–200 airplane is comprised of plates, sheets, extrusions, and forgings of aluminum alloys. Therefore, further improving the physical and mechanical properties of aluminum alloys, while simultaneously decreasing their weight, will have a significant effect on the entire aerospace industry.

The sudden burst of enthusiasm towards nanocrystalline materials stems not only from the outstanding properties that can be obtained in materials, such as increased hardness, higher modulus, strength, and ductility, but also from the realization that early skepticism about the ability to produce high quality, unagglomerated nanoscale powders was unfounded. Additionally, the ability to synthesize an entirely new generation of composites, nanocrystalline metal matrix composites, has further sparked this enthusiasm.

Potential applications for nanocrystalline materials, including their composites, span the entire spectrum of technology, from thermal barrier coatings for turbine blades, to static rocket engine components such as high pressure cryogenic flanges (Integrated High Performance Rocket Propulsion Technology), to electronic packaging, to static and reciprocating automotive engine components. Although structures and mechanical properties of nanocrystalline aluminum alloys have been reported by several researchers, most of the materials produced have been thin ribbons or very small, pellet type powder samples. Cost effective, bulk powder production and near-net-shape product manufacturing is virtually non-existent and offers a significant opportunity in the commercial marketplace. The routine manufacture of functional, near-net-shape components that also maintain the nano-scale morphology has not yet been accomplished.

SUMMARY OF THE INVENTION

It is a major object of the invention to provide a powder metallurgy (PM) process to achieve formation of nanocrystalline aluminum alloy, such as Al-7.5 Mg and a substantially texture free microstructure. In accordance with the process of the invention, Al-7.5 Mg powders were consolidated to full density in seconds via the herein disclosed solid-state consolidation technology. Applicants' solid-state powder metallurgy (P/M) consolidation enabled retention of nanocrystalline virtually texture free grain boundary microstructure. Significant increases in flexure modulus and in flexure strength over commercially available composites have been demonstrated. Similarly, the specific moduli of both coated and forged powders demonstrated significant increases when compared to conventionally produced aluminum metal matrix composite (MMC) products. Near net shape P/M forging of the nanophase MMC powders into prototype structural components was also demonstrated.

Basically, the process includes the steps:

a) pressing the powder into a preform, and preheating the preform to elevated temperature, b) providing a bed of flowable pressure transmiting particles, c) positioning the preform in such relation to the bed that the particles encompass the preform, d) and pressurizing the bed to compress said particles and cause pressure transmission via the particles to the preform, thereby to consolidate the preform into a desired object shape.

For example, a pot die is heated and filled with the pressure transmitting media or (PTM). To maintain thermal uniformity during forging, the PTM is typically heated to a slightly higher temperature than the forging preform consolidation temperature.

In the second step, the forging preform, which is generally a near net shape body typically having a green density of 60–80% of its theoretical density, is heated to the appropriate forging temperature. The forging preform can be fabricated by conventional techniques such as cold isostatic pressing, mechanical pressing, or metal injection molding. Once heated to the correct temperature, the forging preform is lowered into the filled die cavity and buried in the hot PTM.

The next step is pressurization of the PTM, or grain bed, and full densification of the forging preform. During initial pressurization of the PTM, a non-isostatic pressure field is created. During the consolidation process, the powder preform experiences a 30% or near 30% axial compression and a 10% or near 10% radial expansion. This non-uniform pressure field is of significant importance in achieving full density of the powder preform, and in achieving optimal mechanical properties, through the destruction of deleterious particle surface oxides that prevent metallurgical bonding.

The fourth and final step involves decompression of the PTM and separation of the forged product from the PTM. This is easily accomplished by use of a simple screening process and the PTM is then recycled for further use. The surface of the forged product is essentially free of any PTM and a light sandblasting is all that is required to prepare the product for additional processing.

These and other objects and advantages of the invention, as well as the details of an illustrative embodiment, will be more fully understood from the following specification and drawings, in which:

DRAWING DESCRIPTION

FIG. 1(*a*) is a representation of a die in elevation with pressure transmitting media (PTM) in the die, and being heated;

FIG. 1(*b*) is a view like FIG. 1(*a*) showing robot insertion of a heated preform into the PTM;

FIG. 1(*c*) is a view like FIG. 1(*b*) but showing ram pressurization of the PTM to transmit pressure to the embedded heated preform, for consolidating the preform;

FIG. 1(*d*) is a view like FIG. 1(*c*) showing clearing of the die (removal of the consolidated part), and recycling of removed PTM;

Figure 4:
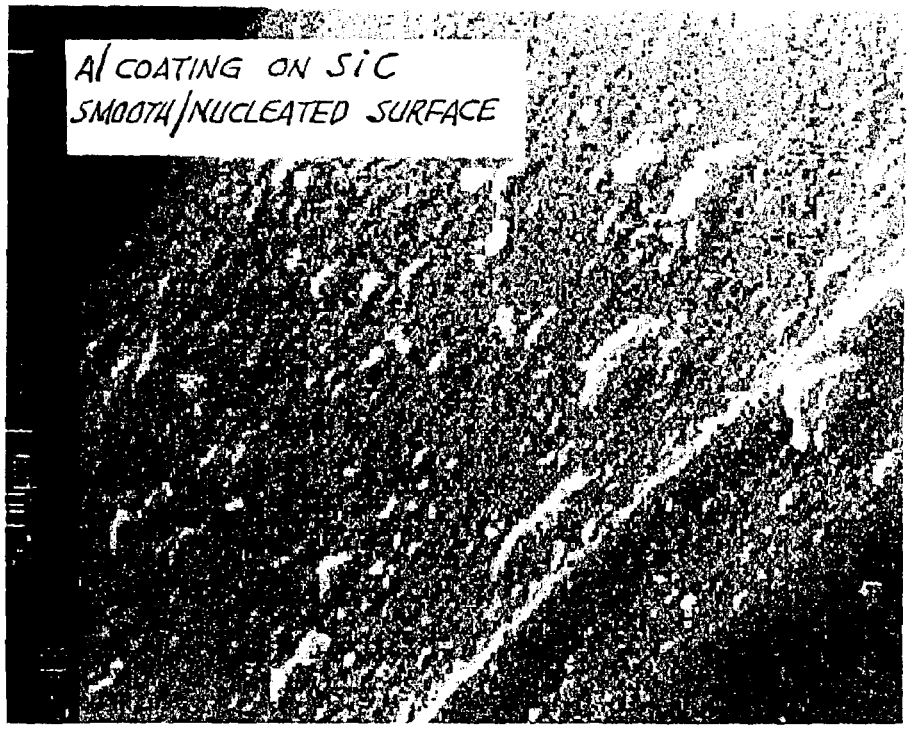
Figure 7:
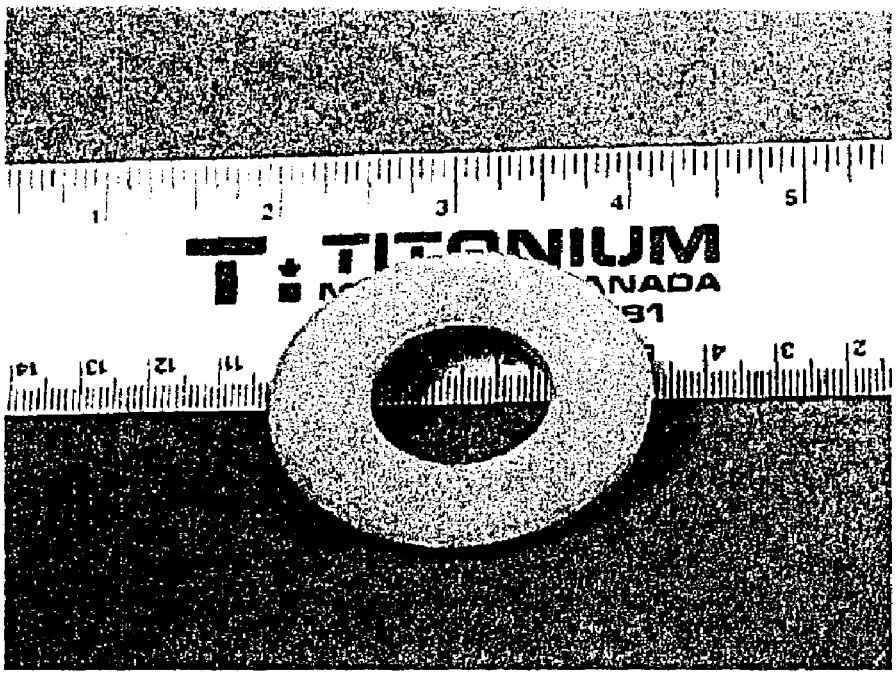
Figure 8:
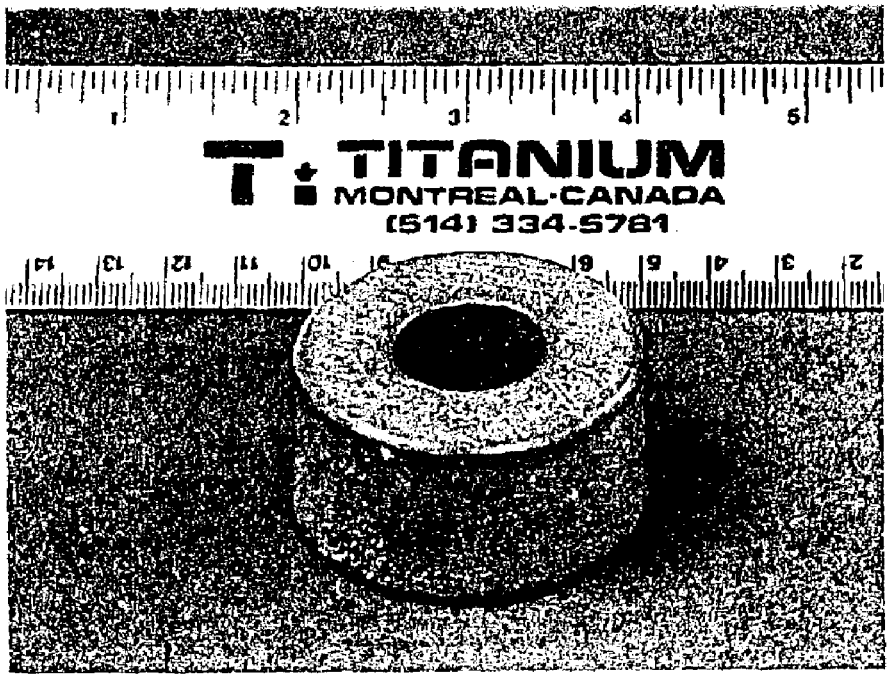
Figure 9:
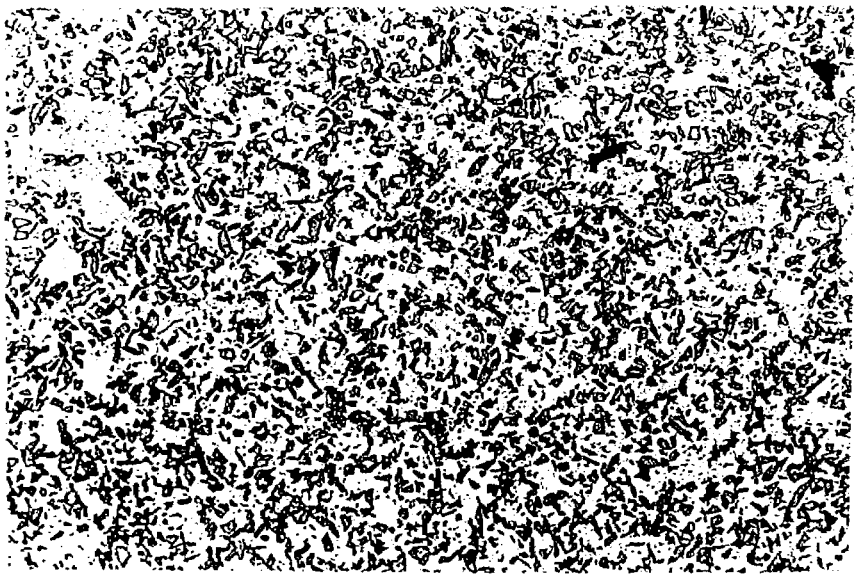
Figure 10:
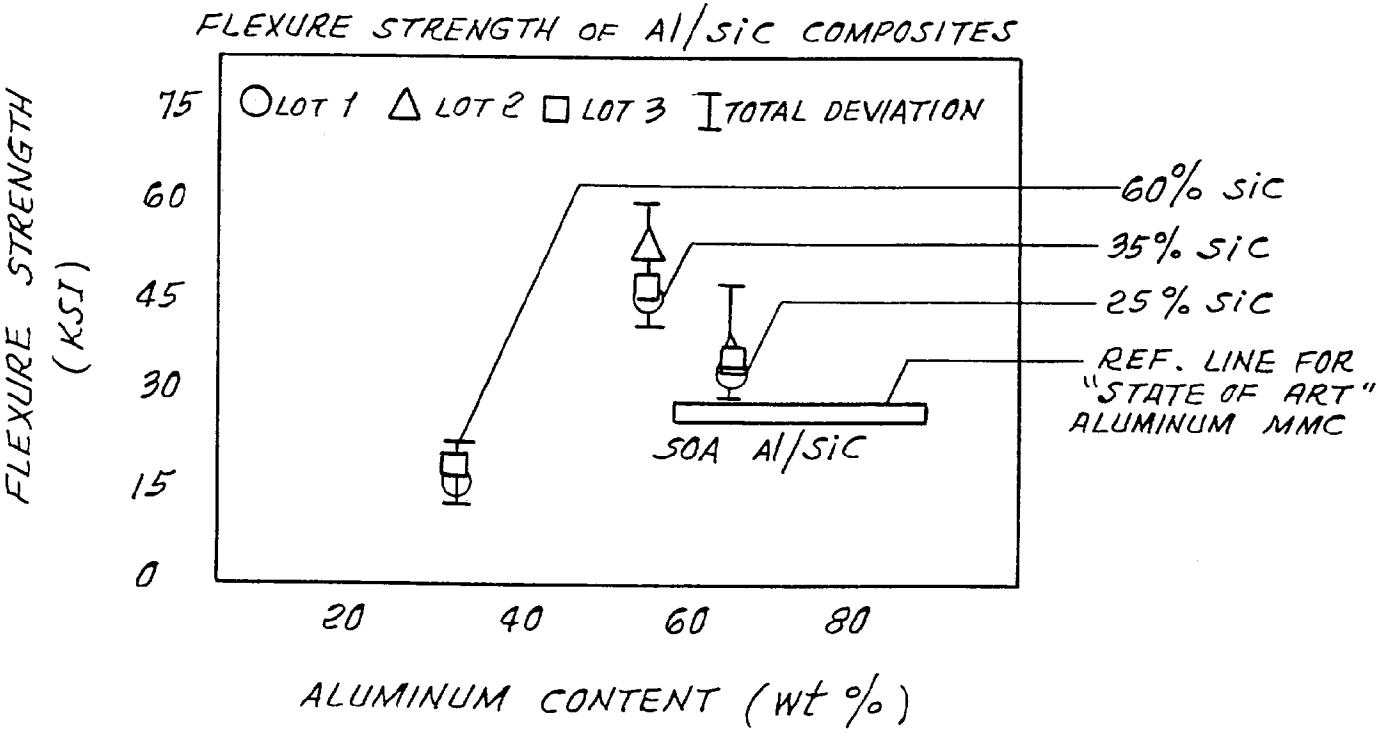
Figure 11:
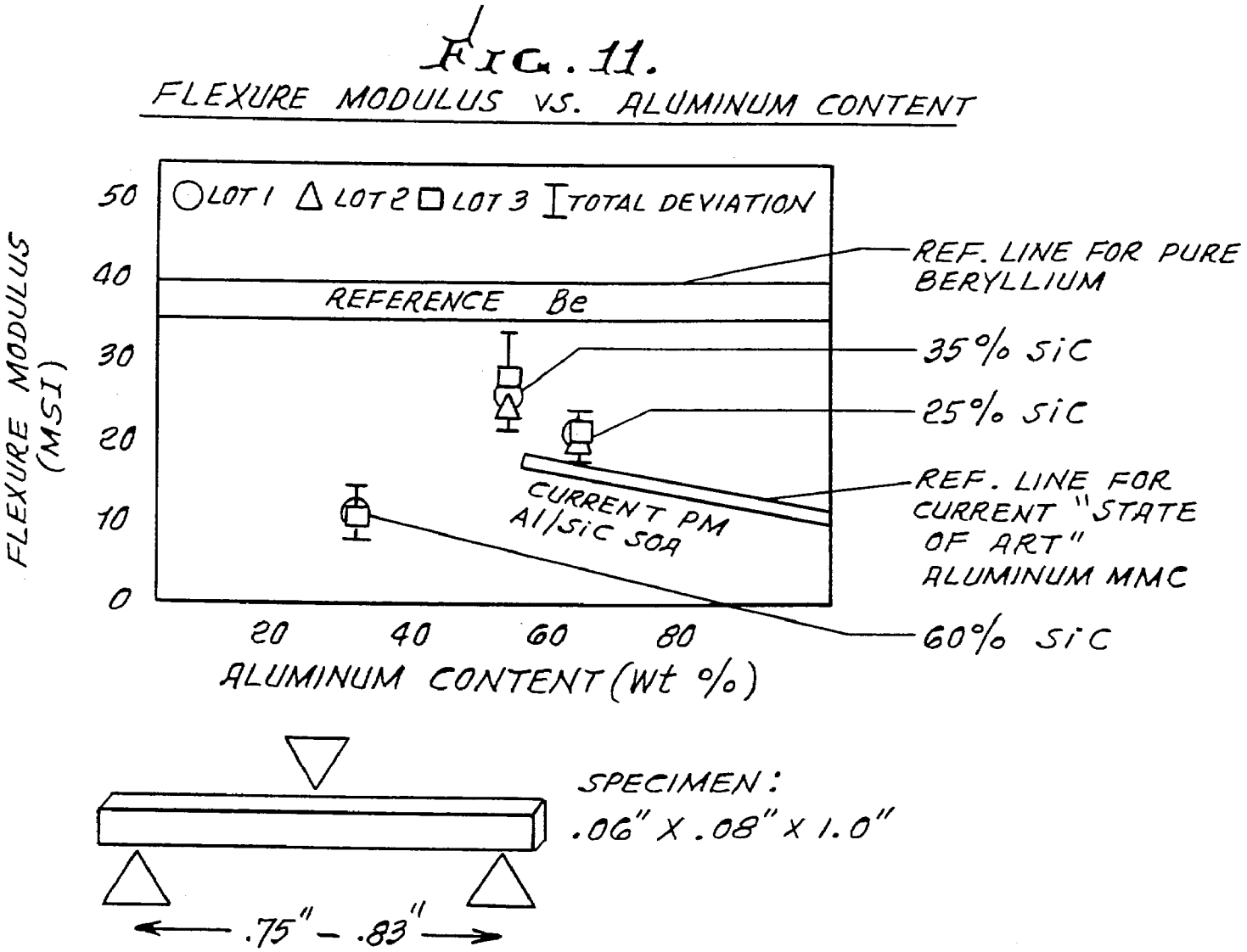
Figure 12:
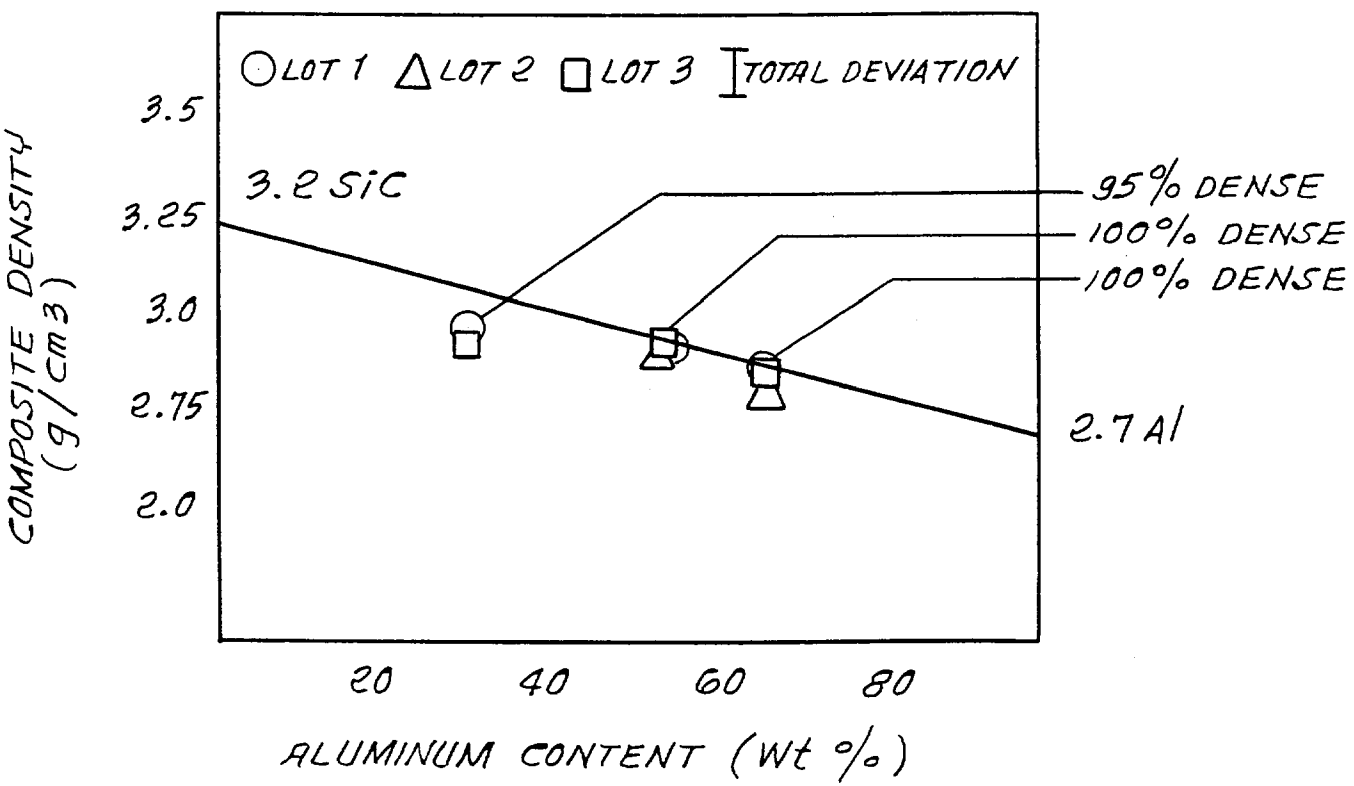

FIG. 3, views (a)–(d), are micrographs;

FIG. 4 is a micrograph showing aluminum coating on silicon carbide powder surfaces;

FIG. 5 is a showing of 80% dense preforms;

FIG. 6 is a comparison of an 80% dense perform (view (a)) and a 100% dense forging (seen at (b)) made from the (a) preform;

FIGS. 7 and 8 are views showing a 100% dense washer and a 100% dense bushing, made in accordance with the process of the invention;

FIG. 9 is a micrograph;

FIG. 10 is a graph showing flexure strength versus aluminum content of sample parts produced in accordance with the invention, and with reference to current "state of the art" material;

FIG. 11 is a graph showing flexure modulus versus aluminum content, of sample parts produced in accordance with the invention with reference to current "state of the art" material; and FIG. 12 is a graph showing composite density versus aluminum content of sample parts made in accordance with the invention.

DETAILED DESCRIPTION

The present process includes a four step manufacturing method for the anisotropic, hot consolidation of powders to form fully dense, near-net-shape parts. In one example, the process involves the rapid (seconds) application of high pressure (1.24 Gpa/180 Ksi) exerted on a heated powder via a granular pressure transmitting media (PTM). Forging temperatures up to 1500° C. are readily achieved. Solid state densification of the near-net-shape occurs in a matter of seconds within a pseudo-isostatic pressure field. The process is uniquely suited to provide ideal powder consolidation and near net shape fabrication environment for the production of nanocrystalline, aluminum metal matrix composites. By design, these composites are extremely hard and abrasion resistant, and secondary finishing operations such as machining and grinding are very difficult and costly. Thus, a near net shape product produced in accordance with the present process offers additional cost savings to the commercial marketplace. The process provides an enabling manufacturing method for the consolidation of numerous powdered materials to form completely dense, near-net-shape parts. The sequence of operations is shown in FIGS. 1, 1(*a*), 1(*b*), 1(*c*), and 1(*d*).

Figure 1:
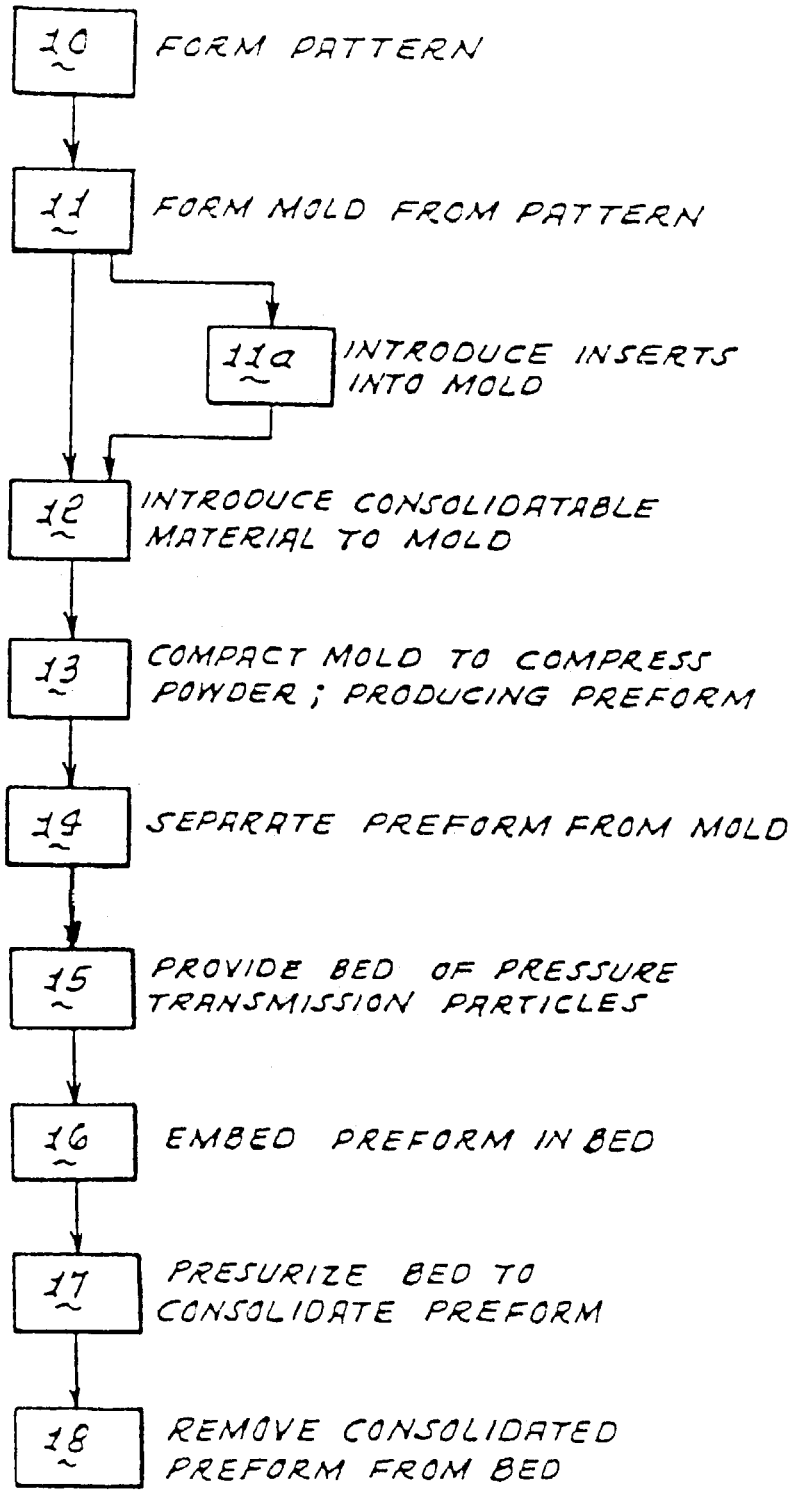
FIG. 1 is a flow diagram.
Figure 1A:
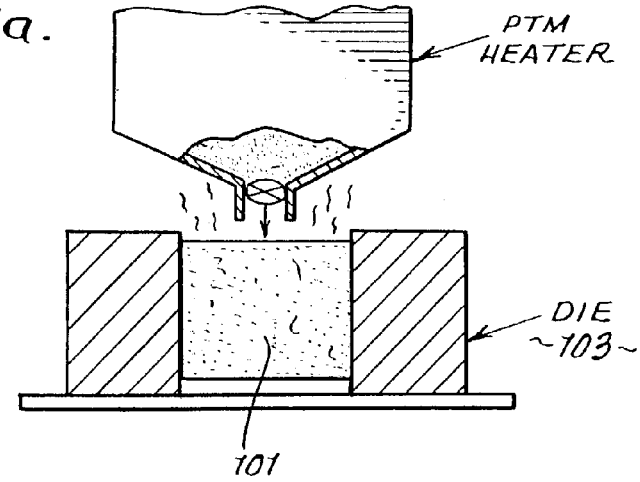
Figure 1B:
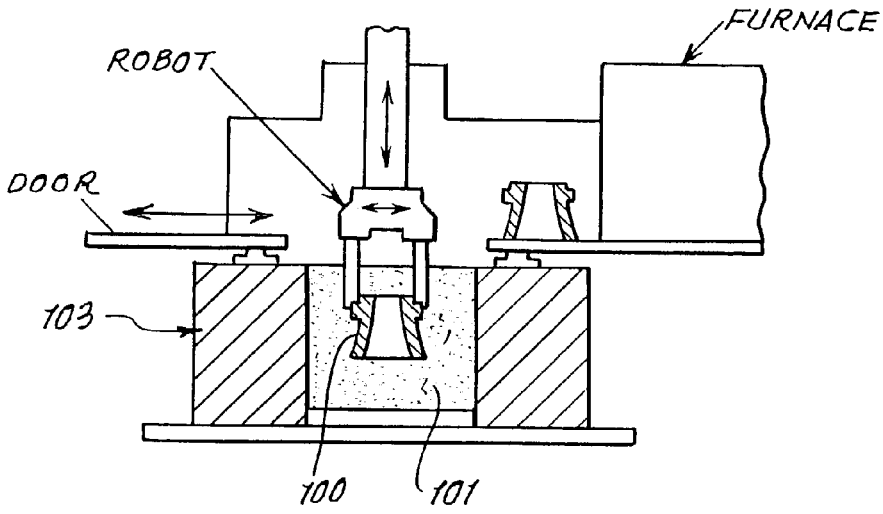
Figure 1C:
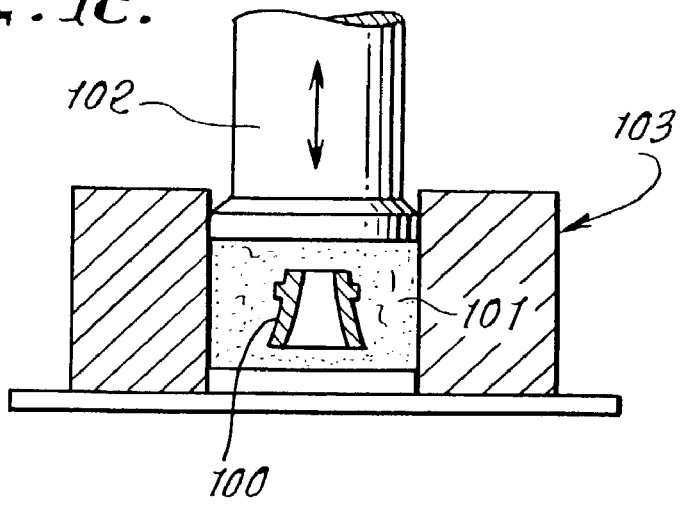
Figure 1D:
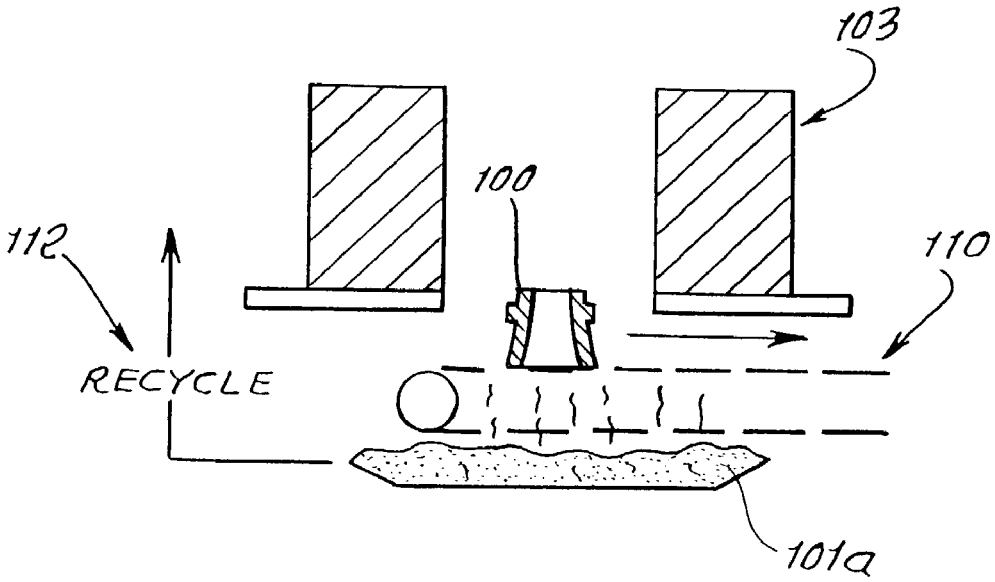

Referring to FIG. 1, a preferred process includes forming a pattern, which may for example be a scaled-up version of the part ultimately to be produced. This step is indicated at 10. Step 11 in FIG. 1 constitutes formation of a mold by utilization of the pattern; as described in U.S. Pat. No. 5,032,352 incorporated herein by reference.

Step 11*a* constitutes the introduction of a previously formed and heated shape, insert or other body into the mold. The shapes may be specifically or randomly placed within the mold. Step 11*a* may be eliminated if inserts are not used.

Step 12 of the process constitutes introduction of consolidatable powder material to the mold, as for example introducing such powder into the mold interior.

Step 13 of the process as indicated in FIG. 1 constitutes compacting the mold, with the powder, inserts, or other body(s) therein, to produce a powder. A preform typically is about 80–85% of theoretical density, but other densities are possible. The step of separating the preform from the mold is indicated at 14 in FIG. 1.

Steps 15–18 in FIG. 1 have to do with consolidation of the preform in a bed of pressure transmitting particles, as for example in the manner disclosed in any of U.S. Pat. Nos. 4,499,048; 4,499,049; 4,501,718; 4,539,175; and 4,640,711, the disclosures of which are incorporated herein by reference. Thus, step 15 comprises provision of the heated bed of particles (carbonaceous, ceramic, or other materials and mixtures thereof). Step 16 comprises embedding of the preform in the particle bed, which may be pre-heated, as the preform may be (see also FIG. 1(*a*) and FIG. 1(*b*) wherein the furnace heated part is introduced into the heated PTM median as by a robot); step 17 comprises pressurizing the bed to consolidate the preform (see also FIG. 1(*c*)); and step 18 refers to removing the consolidated preform from the bed. See FIG. 1(*d*). The preform is typically at a temperature between 1,050° C. and 1,350° C. prior to consolidation. The embedded powder preform is compressed under high uniaxial pressure typically exerted by a ram, in a die, to consolidate the preform to up to full or near theoretical density.

More specifically, and referring to steps 12–14 in FIG. 1, heated powdered material is poured into a mold. If the mold is rigid as in mechanical pressing, a punch and die arrangement is used to compress and form the loose powder. Alternatively, a flexible elastomer mold is filled with powder, evacuated and sealed. The sealed elastomer mold is then placed in a high-pressure vessel and subjected to hydrostatic pressure of approximately 50,000 psi. In either case, the result is a powder preform that is approximately eighty percent dense. The preform now has enough strength to be handled, but it is not a functional part at this time. The preform is then heated to the lowest temperature that will permit complete densification. This temperature is determined through a comprehensive parametric study of temperature, pressure, dwell time and strain rate, for each material. Part heating may be accomplished by any number of conventional methods such as radiation or induction heating.

The PTM is heated via a fluidized bed technique to a temperature that has been determined from the parametric study to yield a fully dense material. Several types of pressure transmitting media are used depending upon the material being densified.

Referring to FIGS. 1(*c*) and 3, a simple pot die 103 is partially filled at 101 with the heated PTM. Next the heated powder forging preform 100 is securely placed into the partially filled pot die. Additional heated PTMJ may be poured into the pot die sufficient to cover the heated powder preform. Finally, the forging ram 102 is lowered into the pot die where it comes in contact with the heated PTM. As pressure continues to increase, the forging ram first pressurizes the heated PTM which in turn pressurizes and virtually instantaneously densities the near-net-shape powder perform, as the ram is further lowered. Typically, the preform powdered articulate undergoes about 30% compression in the direction of ram force application to the bed, and about 10% expansion in direction or directions normal to that force application direction.

Referring to FIG. 1(*d*), after the consolidation step has been completed, a simple screening technique indicated at 110 separates the PTM and part. The now fully dense, near net shape part may be sandblasted and directly placed into a heat treat quench tank. The separated PTM 101*a* is now ready for recyling at 112 through the fluidized bed furnace, for further use. The process is capable of producing fully dense, near net shape components at cycle times as low as 3 to 5 minutes. Precise control of the fluid die forging processing parameters and the powder metal's initial total oxygen content, chemical composition and particle size distribution, provides for a cost effective, reliable and reproducible manufacturing technology.

Figure 2:
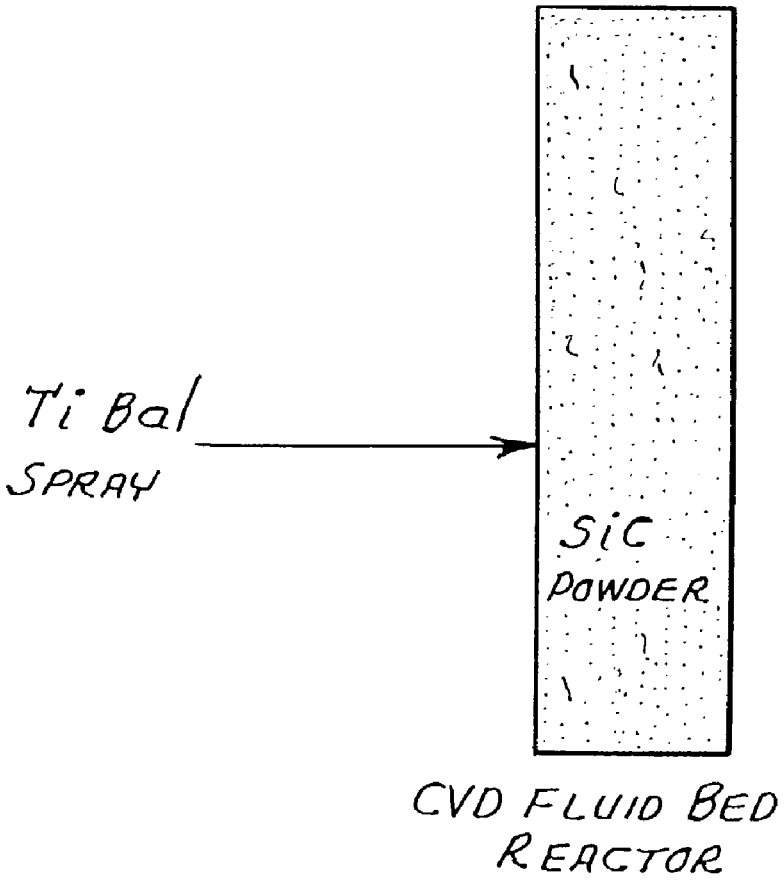
FIG. 2 is an elevation showing a continuous fluidized bed reactor.
Figure 3A:
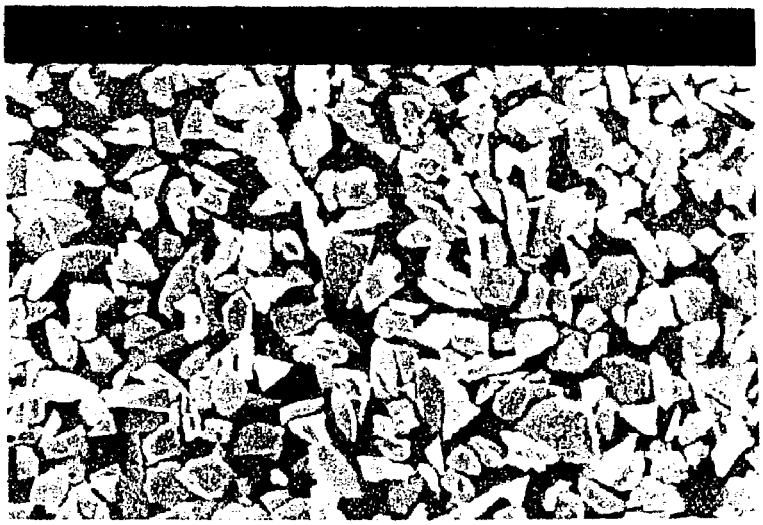
Figure 3B:
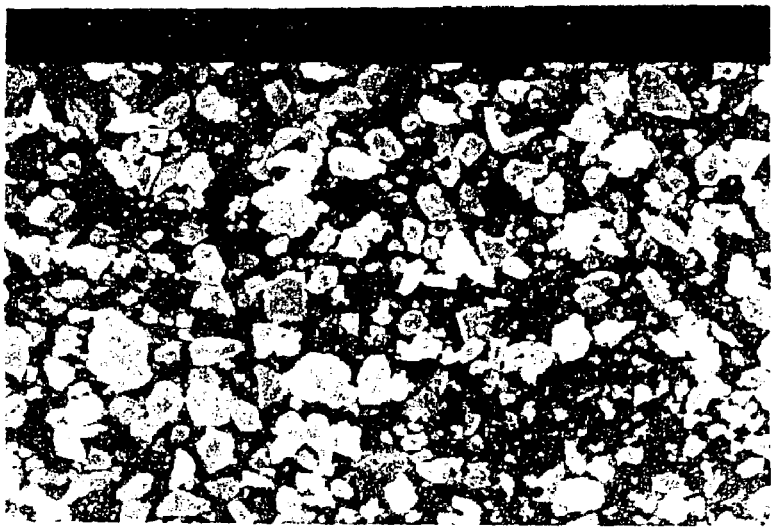
Figure 3C:
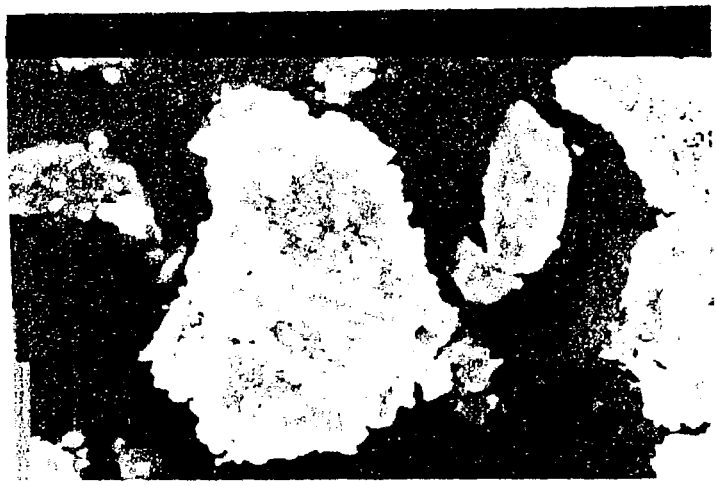
Figure 3D:
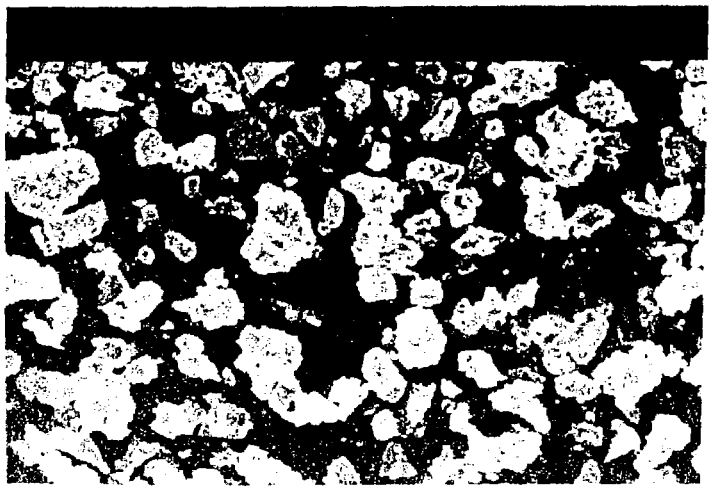

The chemical vapor deposition process used by Powdermet, Inc., Sun Valley, Calif., produces 25 v/o SiC nanocrystalline powder. In the coating process, the reactor as shown in FIG. 2 utilizes argon gas to suspend 10–15 μm SiC particles in a reactive aluminum metal precursor that is vaporized and flash injected into the reactor. During the coating process each individual SiC particle becomes encapsulated by aluminum metal, and eventually a total coating thickness of approximately 2-3-2 microns is achieved. After removal from the reactor the coated particles develop a passive oxide layer 10–15 nm in thickness, that eventually serve as the dispersion-strengthening constituent. The resultant composite powders are then screened and classified to determine their particle size distribution. FIG. 2 shows the continuous fluidized bed reactor. Other processes to produce aluminum encapsulated powder particles, consisting for example of SiC can be used.

The coated powders are un-agglomerated and when compacted have excellent green strength. FIG. 3 is a representative example of the "uncoated SiC" and "as coated" composite powders at different magnifications. The aluminum powder builds on the SIC particle surface first by nucleation, and then growth. The deposited aluminum morphology assumes either a nodular or "feathery" structure as shown in FIG. 4.

After compacting at 15 TSI (207 Mpa) the 25 v/o SiC powder achieved a green density of 2.30 g/cc, or 80% of its theoretical density. FIG. 5 shows various 80% dense forging preforms while FIG. 6 demonstrates the deformation associated with going from an 80% dense forging preform, to its 100% dense form.

A parametric study has been conducted to determine the optimal combination of forging temperature and pressure for the nanocomposite powder. Three objectives were of highest interest during the forging study:

achieving full density maintaining structural integrity of the near net shape preserving the nanocrystalline structure Upon completion of the forging study, one set of parameters, as shown in Table 1, allowed all three objectives to be successfully accomplished.

TABLE I

| PART TEMP | PART SOAK | PTM TYPE | FORGE PRESSURE |
|---|---|---|---|
| 550° C. | 10 min. | SGAL | 876 Mpa(127 ksi) |

Application of the P/M forging technology disclosed herein to a highly loaded (25 v/o SiC) aluminum nanocrystalline powder demonstrated that the near net shape production of structural components is feasible. FIGS. 7 and 8, as well as FIG. 6*b*, clearly demonstrate flexibility in part size.

Scanning electron microscopy was performed on the 25 v/o SiC matrix to determine how well the SiC particles were distributed throughout the matrix, and if pooling of the aluminum coating, caused by too high a forging temperature, was evident. FIG. 9 demonstrates the excellent manner in which the CVD coated SiC particles are randomly distributed in the matrix as well as the absence of thermally induced aluminum pools.

Texture analysis using X-ray diffraction was successfully completed on a 25 v/o SiC sample forged at 550 Centigrade and 127 kpsi, by LAMBDA Research. The (111), (200) and (220) back-reflection pole figures were obtained for each sample. The direct pole figures were used in conjunction with the Los Alamos (popLA) texture analysis software to calculate the Orientation Distribution Function (ODF) for each sample using WIMV analysis. Upon completion of the measurements and final compilation of the data it was determined that no preferential grain orientation existed in the forged sample.

X-ray diffraction analysis was also used to determine the aluminum crystallite grain size in the 25 v/o SiC composite. The (200) and (400) diffraction peak profiles were obtained on a horizontal Bragg-Brentano focusing diffractometer, using graphite-monochromated Cu K-alpha radiation, an incident beam divergence of 1 degree and a 0.2 degree receiving slit. Diffraction peak profiles were obtained by step scanning over a range of approximately eight times the half-width for both the (200) and (400) diffraction peaks. The data collection ranges were adjusted to avoid interference with neighboring peaks.

The $K\alpha_1$ diffraction peak profiles were reconstructed and separated from the $K\alpha_2$ doublet using Pearson VII function line profiles analysis. The $K\alpha_1$ peak profiles were corrected for instrumental broadening by Stokes' method, using NIST SRM 660, lanthanum hexaboride, by instrument line positioning and profile shape standard, assumed to be free of particle size and microstrain broadening. The shape of the two contributing line profiles, size and strain, were represented by Cauchy and Gaussian distribution functions, respectively.

The effective crystallite size of the diffracting domains in the aluminum phase coated onto the SiC particles was found to be approximately 82.9 nm. In addition, an effective microstrain of 0.00199 was also determined from the measurements preformed.

Three point bend tests were preformed on samples ground from the "as forged" composite. For this study, no attempt was made to thermally control or modify the microstructure. The flexure strength and modulus of the 25 v/o SiC composite, as well as forged 35 v/o and 60 v/o CVD compositions were compared against current state-of-the-art material. Results are shown in FIGS. 10 and 11.

As evidenced from FIGS. 10 and 11, the forged nanocrystalline material is substantially superior to current state-of-the-art composites of like composition. The cause for the low strength and modulus of the 60 v/o SiC composite is due to the fact that the forged density reached only 95% of its theoretical value. The relationship between forged density to the theoretical density for a specific composition can be seen more clearly in FIG. 12.

Chemical vapor deposition using a "Continuous Fluidized Bed Reactor" is an effective technique for the production of bulk quantities of high volume fraction (25–60 v/o SiC) nanocrystalline Al/$SiC_p$ metal matrix composite powders.

Solid-state forging of the nanocrystalline powders produces fully dense, near net shape structural components exhibiting excellent flexure strength and high modulus. Current data demonstrates increases in flexure strength and modulus of 25 to 50% over current state-of-the-art material of similar composition.

The aluminum crystallite grain size in the as-forged 25 v/o SiC composite was determined to be 82.9 nm, and the microstructure was texture free.

The invention is applicable to:

- forging (solid-state forging) of aluminum/SiC metal matrix composite compositions
- pure aluminum matrix, 2xxx, 6xxx, 7xxx alloy matrices and "others" of aluminum
- aluminum magnesium alloy, such as Al-7.5 Mg
- low to high volume fraction of SiC particulate re-enforcement (5 to 70 volume %)
- also applicable to "other" metallic and ceramic matrix composite compositions, such as titanium, iron, and alumina, silicon nitride
- unique to herein disclosed forging technique aluminum metal matrix composite in that the tenacious oxide coating inherent on the aluminum powder particles is first "broken up" allowing clean metal powder surfaces to bond, and then the oxide is actually dispersed throughout the aluminum metal matrix and acts as a secondary strengthening element by pinning aluminum grain boundaries and retarding grain growth of the aluminum
- methods of powder production include mechanical blending, pre-alloyed, CVD, mechanical alloying, etc.

All of these methods produce powders which can be consolidated into near net shape, metal matrix composite products.

An important feature of the invention is the provision of a consolidated powder metal object consisting essentially of a component or components selected from the group a) metal, b) metal oxide, c) matrices of a) and b), d) matrices of a) and/or b) and/or c) that include silicon carbide, to form an object, and characterized by substantially completely texture free microstructure at metallic grain boundaries.

The metal of the object as referred to is typically selected from the group consisting of i) alumina
ii) titanium
iii) iron
iv) silicon nitride
v) magnesium.

The oxide of said metal may be dispersed in the matrix, strengthening the matrix.

Another important aspect of the invention is the provision of a consolidated powder metal object consisting essentially of a first component or components selected from the group a) coating X, b) oxide of coating X, c) matrices of a) and b), d) matrices of a) and/or b) and/or c), that component consisting of pressure bonded nanocrystalline particulate, together with carbide particulate dispersed in said pressure bonded particulate, to form said object, and characterized by substantially completely texture free microstructure at particle boundaries.

The matrix strengthening carbide is typically selected from the group consisting essentially of i) silicon carbide
ii) titanium carbide (TiC)
iii) boron carbide ($B_4C$)

The component X may be dispersed in the pressure bonded particulate, strengthening said object. The addition of the carbide constituent also increases wear resistance of the matrix, lowers its specific gravity, and increases corrosion resistance.

As used herein, the term "nanocrystalline" refers to a grain or particle size (maximum cross dimension) less than 100 nanometers.

A further objective of the invention is to accomplish consolidation of nanocrystalline Al-7.5 Mg powder, employing the consolidation steps as referred to. This is accomplished with the following parameters:

a) % axial compression of the preform is about 30%,
b) % radial expansion of the preform is about 10%,
c) grain size of the Al-7.5 Mg is between 40 and 60 nanometers, and preferably about 50 manometers,
d) the powder has been cryogenically milled, as indicated at 12*a* in FIG. 1, as for example ball milling in a vessel, at cryogenic temperature, in liquid nitrogen, and in the absence of air,
e) pressurizing of the powder to produce consolidation is effected at between 750° F. and 875° F., and during a dwell interval of less than 1 minute.

More specifically, and in comparison, the process makes use of a granular pressure transmitting media (PTM) to transform high axial pressure (106 ksi/731 Mpa) from a hydraulically driven ram into a quasi-isostatic pressure field that is in turn directly applied to canned nanophase powder. In the process, the canned nanophase powder is rapidly pre-heated to 850° F./454° C. and held there for 5 minutes to thermally stabilize. The quasi-isostatic pressure field is applied and simultaneously introduces a beneficial shearing effect during powder consolidation that destroys tenacious powder surface oxides. Full densification of the nanophase powder occurs within seconds.

During quasi-isostatic densification, the powder particles experience a non-uniform pressure field that causes an approximate 30% axial compression and 10% radial expansion that literally tears the powder surface oxides apart and re-distributes them within the matrix. This provides the opportunity for clean, oxide free aluminum surfaces to be forged together, providing the potential to achieve an "as forged" ductility unavailable with other densification technologies, and the opportunity to reduce subsequent manufacturing steps such as extrusion.

Methods and consolidated objects as specifically disclosed herein are preferred.

We claim:

1. The method of consolidating metal powder consisting essentially of aluminum alloy that includes:

a) pressing said powder into a preform, and preheating the preform to elevated temperature,
b) providing a bed of flowable and heated pressure transmitting particles, c) positioning the preform in such relation to the bed that the particles encompass the preform, d) and pressurizing said bed to compress said particles and cause pressure transmission via the particles to the preform, thereby to consolidate the preform into a desired object shape, e) said pressurizing being carried out to effect alloy preform powder particulate axial compression and radial expansion, where the % said axial compression exceeds the % said expansion, effecting disruption of powder surface oxides and their redistribution in the consolidating preform matrix.

2. The method of claim 1 wherein said alloy comprises aluminum magnesium alloy.

3. The method of claim 2 wherein said alloy comprises Al-7.5 Mg.

4. The method of claim 1 wherein said % compression is about 30%, and said % expansion is about 10%.

5. The method of claim 1 wherein the grain size of the powder pressed into the preform is between 40 and 60 nanometers.

6. The method of claim 1 wherein the grain size of the powder pressed into the preform is about 50 nanometers.

7. The method of claim 5 including cryogenically milling the powder.

8. The method of claim 1 wherein said pressurization is effected at between 750° and 875° F.

9. The method of claim 8 wherein said pressurizing is effected during a dwell interval of less than about 1 minute.

10. The method of claim 9 wherein the consolidated preform matrix contains distributed Al-7.5 Mg alloy particles, and said compression is about 30% said expansion is about 10%.

11. The method of claim 1 wherein said pressurizing is carried out to maintain a pressure nanocrystalline grain size in the consolidated preform.

12. The method of claim 1 including preheating the pressure transmitting particles, which are one of the following:

i) carbonaceous ii) ceramic iii) mixtures of i) and ii).

13. The method of claim 12 wherein the pressure transmitting particles in the bed are preheated to elevated temperatures between 1,000° C. and 1,300° C.

14. The method of claim 1 wherein the preform is pre-heated to elevated temperature between 1,050° C. and 1,350° C.

15. The method of claim 1 wherein the preheated preform is positioned in said bed, the particles of which are at elevated temperatures.

16. In the method of compacting a body or plurality of bodies in any of initially powdered, sintered, fibrous, sponge, or other particulate form capable of compaction and forming, that includes the steps:

a) providing flowable pressure transmission particles having carbonaceous and/or ceramic composition or compositions, or composites thereof, b) locating said particles in a bed, c) positioning said body relative to said bed, to receive pressure transmission, d) effecting pressurization of said bed in a first direction to cause pressure transmission via said particles in a second direction or directions to said body, thereby to compact the body generally longitudinally and laterally into desired shape, increasing its density, and characterized by substantially texture free nanocrystalline grain size microstructure at body grain boundaries, body particulate being subjected to compression in a first direction and expansion in a second direction during said pressurization.

17. The method of claim 16 wherein the body particulate consists of lightweight metal and oxides thereof.

18. The method of claim 16 wherein the body particulate consists essentially of Al-7.2 Mg.

19. The method of claim 16 wherein said first direction is substantially axial and said second direction or directions is or are radial.

20. The method of claim 16 wherein said pressurization is effected at levels greater than about 80,000 psi for a time interval of less than about 30 seconds.

21. The method of claim 16 including heating said body to a temperature above 500° C. but less than about 600° C., prior to said step c).

22. The method of claim 16 wherein said pressure transmission particles include one of the following:

i) carbonaceous ii) ceramic iii) mixtures of i) and ii).

23. The method of claim 22 wherein the pressure transmission particles in the bed are pre-heated to elevated temperatures between 500° C. and 1,300° C.

* * * * *